US005201424A

United States Patent [19]

Hain

[11] Patent Number: 5,201,424

[45] Date of Patent: Apr. 13, 1993

[54] APPARATUS FOR TESTING THE STIFFNESS OF A SHEET

[75] Inventor: David A. Hain, Dundee, Scotland

[73] Assignee: NCR Corporation, Dayton, Ohio

[21] Appl. No.: 785,368

[22] Filed: Oct. 30, 1991

[30] Foreign Application Priority Data

Jul. 4, 1991 [GB] United Kingdom ..... 9114469

[51] Int. Cl.[5] ..... B07C 5/00

[52] U.S. Cl. ..... 209/534; 271/188; 271/209; 73/159; 209/599

[58] Field of Search ..... 271/188, 209, 258, 259, 271/265; 209/534, 599, 576; 73/159

[56] References Cited

U.S. PATENT DOCUMENTS

| | | | |
|---|---|---|---|
| 3,067,999 | 12/1962 | Skeen | 271/274 |
| 3,202,778 | 8/1965 | Fliegner et al. | 271/258 X |
| 3,552,563 | 1/1971 | Smith | 209/534 |
| 3,863,913 | 2/1975 | Hirafuji | 271/265 |
| 4,501,642 | 2/1985 | Wells | 73/159 X |
| 4,687,106 | 8/1987 | Prins | 209/603 X |
| 4,703,097 | 11/1972 | Kilpatrich et al. | 73/159 |
| 3,966,198 | 6/1976 | Komada et al. | 271/265 |
| 5,029,469 | 7/1991 | Chase et al. | 73/159 |
| 5,101,661 | 4/1992 | Cresson et al. | 73/159 |

FOREIGN PATENT DOCUMENTS

| | | | |
|---|---|---|---|
| 0073133 | 8/1982 | European Pat. Off. . | |
| 0357406 | 8/1989 | European Pat. Off. . | |
| 1294723 | 5/1969 | Fed. Rep. of Germany | 209/599 |
| 2085850 | 5/1982 | United Kingdom | 209/534 |

*Primary Examiner*—H. Grant Skaggs
*Assistant Examiner*—Carol Lynn Druzbick
*Attorney, Agent, or Firm*—Albert L. Sessler, Jr.

[57] ABSTRACT

An apparatus for testing the stiffness of a sheet, such as a currency note, includes first cooperating rollers (36, 38) and second cooperating rollers (28, 32) arranged to urge the sheet along a feed path (48) The first rollers (36, 38) engage frictionally with the sheet and are caused to rotate with a greater peripheral speed than the second rollers (28, 32). As a result, there is a tendency for the first rollers (36, 38) to cause that portion of the sheet between the first and second rollers (36, 38; 28, 32) to buckle, this tendency being resisted if the sheet has a required degree of stiffness. First and second sensors (66, 68) are disposed on opposite sides of said feed path (48) for sensing a deflection of said portion of said sheet away from the feed path (48) by at least a predetermined amount, brought about by buckling of the sheet due to the sheet being insufficiently stiff.

19 Claims, 4 Drawing Sheets

FIG. 7.
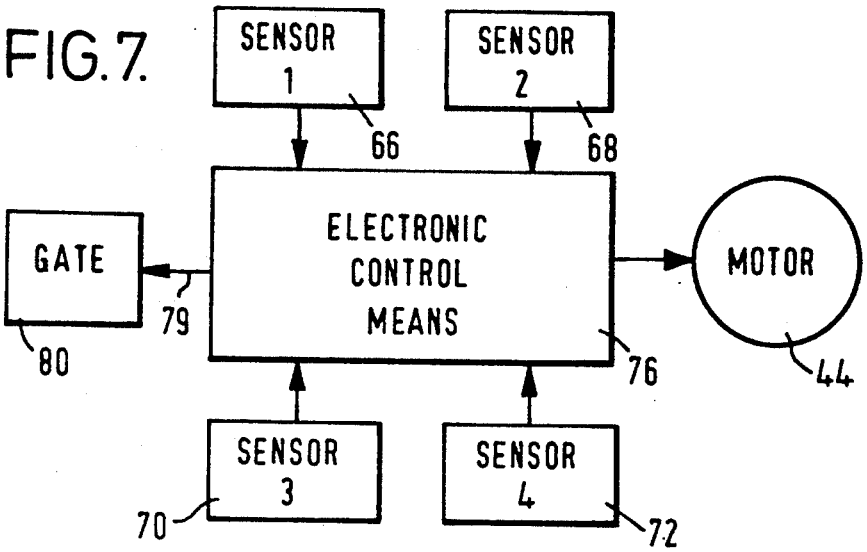
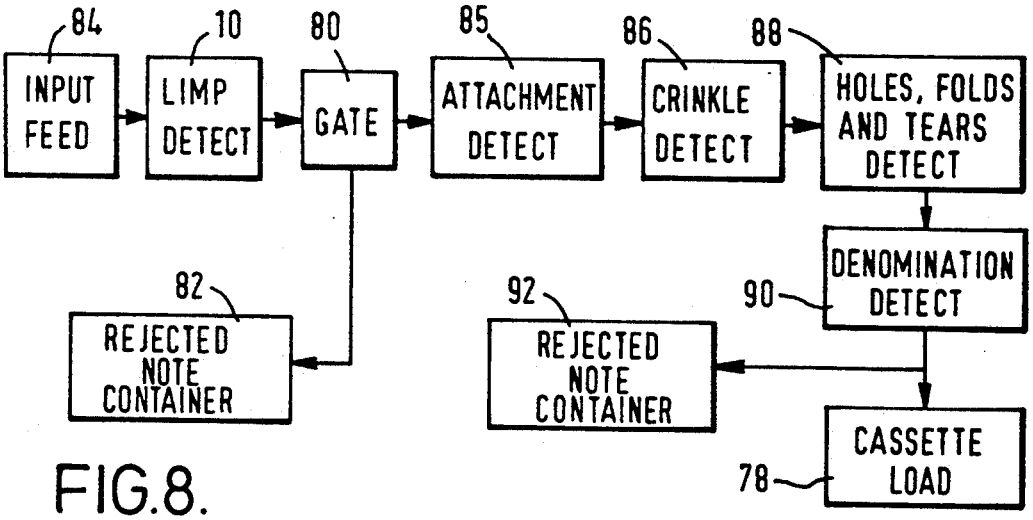
FIG. 8.

APPARATUS FOR TESTING THE STIFFNESS OF A SHEET

BACKGROUND OF THE INVENTION

The present invention relates to an apparatus for testing the stiffness of a sheet and more particularly, but not exclusively, to an apparatus for testing the stiffness or crispness of a paper sheet such as currency note.

Prior to the loading of currency notes into currency cassettes for use with automated teller machines (ATMs), it is important to screen the currency notes to detect their condition. In particular, there is a requirement to detect and reject currency notes having holes, or other defects, or having attachments such as tapes or staples. It is also important to detect whether or not a currency note has the necessary degree of stiffness or crispness for satisfactory handling by a cash dispensing mechanism; if it does not, the currency note should be rejected to ensure that it is not loaded into a currency cassette.

An apparatus for determining the condition of currency notes by testing their stiffness is disclosed in European Patent Application No. 0073133. This prior art apparatus determines the condition of a currency note on the basis of the noise made by the currency note as it is bent around a bobbin-shaped drum. This prior art technique has the disadvantage that, as a result of noise interference, incorrect determinations of the stiffness of currency notes may be made.

SUMMARY OF THE INVENTION

According to the invention there is provided an apparatus for testing the stiffness of a sheet comprising transport means for feeding said sheet along a feed path, said transport means including first and second rotary means arranged to engage with said sheet so as to urge said sheet along said feed path, said second rotary means being spaced from said first rotary means downstream thereof, said transport means also including drive means for driving said first and second rotary means simultaneously when said sheet is being fed from said first rotary means to said second rotary means, whereby the peripheral speed of said first rotary means is greater than that of said second rotary means, said first rotary means being arranged to engage frictionally with said sheet and to exert on said sheet a lower feeding force along said feed path than the feeding force along said feed path exerted on said sheet by said second rotary means; and sheet deflection sensing means for sensing a deflection of a portion of said sheet between said first and second rotary means away from said feed path by at least a predetermined amount to measure the stiffness of said sheet.

It should be understood that, in the present specification and claims, by feed path is meant the path followed by a transported sheet when it undergoes no buckling or other deformation.

It is an object of the present invention to provide an apparatus for testing the stiffness of a sheet, such as a currency note, which apparatus overcomes the disadvantage of the aforementioned prior art apparatus, and which also is of simple construction.

With this and other objects, which will become apparent from the following description, in view, the invention includes certain novel features of construction and combinations of parts, a preferred form or embodiment of which is hereinafter described with reference to the drawings which accompany and form a part of this specification.

BRIEF DESCRIPTION OF THE DRAWINGS

FIG. 7 is a block diagram illustrating the electrical interconnections of an apparatus in accordance with the invention associated with gate means for diverting rejected notes; and FIG. 8 is a schematic block diagram illustrating features of a currency cassette loading system incorporating an apparatus in accordance with the invention.

DETAILED DESCRIPTION

Figure 1:
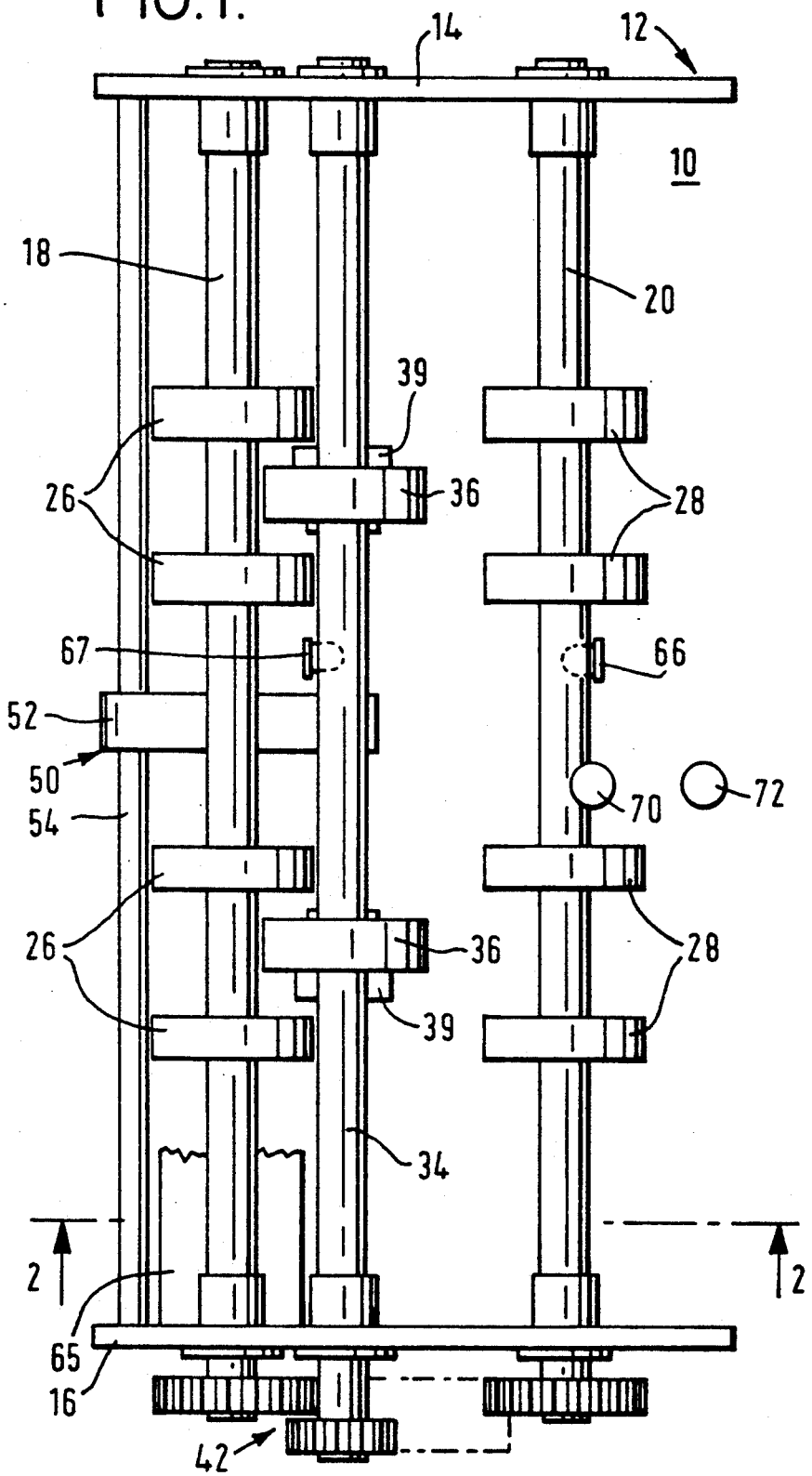
FIG. 1 is a plan view of a limp currency note detect mechanism.
Figure 2:
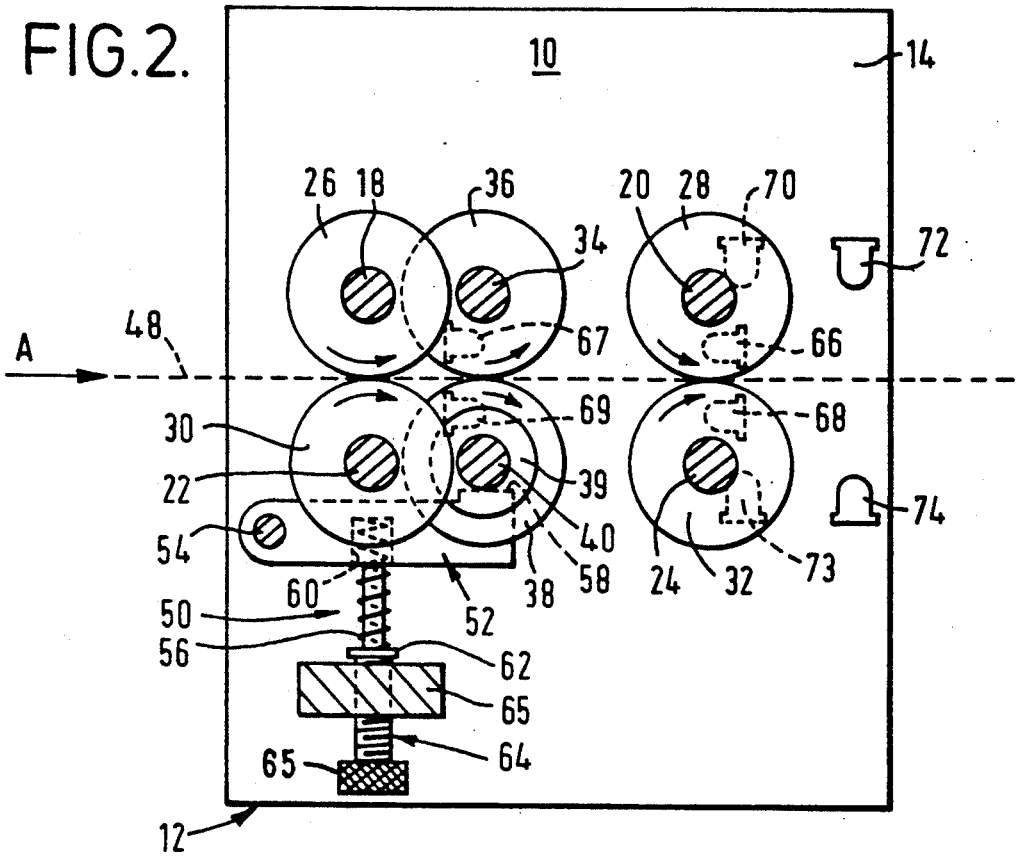
FIG. 2 is a sectional, side elevational view of the mechanism of FIG. 1, the view being taken along the line 2—2 of FIG. 1.

Referring to FIGS. 1 and 2, the limp currency note detect mechanism 10 shown therein is arranged to test the quality of currency notes fed one by one to the mechanism 10 in the direction of the arrow A in FIG. 2 by external transport means (not shown). It should be understood that each note fed to the mechanism 10 is disposed with its long edges perpendicular to the direction of feeding. The mechanism 10 includes a framework 12 having side walls 14 and 16. Two upper drive shafts 18 and 20 and two lower drive shafts 22 and 24 extend between, and are rotatably mounted with respect to, the side walls 14 and 16, the shafts 22 and 24 being respectively positioned directly below the shafts 18 and 20. Four sets of rubber feed rollers 26, 28, 30 and 32 are respectively secured to the shafts 18, 20, 22 and 24. As shown in FIG. 2, the rollers 26 are in cooperative engagement with the rollers 30, and the rollers 28 are in cooperative engagement with the rollers 32.

A further drive shaft 34, on which are mounted two polyurethane foam rollers 36, extends between, and is rotatably mounted with respect to, the side walls 14 and 16, the shaft 34 being located between the shafts 18 and 20. Each of the rollers 36 is disposed between an adjacent pair of the feed rollers 26, as shown in FIG. 1. Two further polyurethane foam rollers 38 are rotatably mounted by means of bearings 39 on a shaft 40 which is positioned directly below the shaft 34, the rollers 38 being in cooperative engagement with the rollers 36, as shown in FIG. 2.

The ends of the shaft 40 are slidably mounted in two vertically extending slots (not shown) respectively formed in the side walls 14 and 16, so that a certain amount of vertical movement of the shaft 40 is permitted. It should be understood that the polyurethane foam rollers 36 and 38 are relatively compressible compared with the rubber feed rollers 26, 28, 30 and 32.

The drive shafts 18, 20, 22, 24 and 34 are driven by a gear mechanism 42 (FIG. 1), which in turn is driven by an electric motor 44 (FIG. 7), so that in operation the rollers 26, 28, 30, 32 and 36 rotate in the directions of the relevant arrows in FIG. 2. The rotatably mounted rollers 38 also rotate in the direction of the relevant arrow in FIG. 2 by virtue of being urged against the rollers 36. The gear mechanism 42 serves to cause the rubber feed rollers 26, 28, 30 and 32 to rotate with the same peripheral speeds, but causes the polyurethane foam rollers 36 (and consequently also the rollers 38) to rotate with a peripheral speed approximately two and one-fourth times the peripheral speeds of the rollers 26, 28, 30 and 32.

As will be described in more detail later, a currency note such as the note 46 (FIGS. 3 and 4) is fed in operation through the mechanism 10 along a feed path 48 in the direction of the arrow A, the note 46 being fed between cooperating pairs of rollers 26, 30; 36, 38 and 28, 32. The cooperating feed rollers 26, 30 and 28, 32 exert a fixed pressure on each other, but the pressure between the polyurethane foam rollers 36, 38 can be adjusted by adjustment means 50. The adjustment means 50 includes an arm 52 pivotably mounted at one end on a shaft 54 extending between the side walls 14 and 16. The arm 52 is urged to pivot in a counterclockwise direction (with reference to FIG. 2) by means of a vertically extending compression spring 56 so that an upper surface 58 of the arm 52 remote from the shaft 54 engages with a portion of the shaft 40 between the rollers 38. The upper end of the spring 56 engages in a recess 60 formed in the underside of the arm 52, while the lower end of the spring 56 engages with a collar 62 provided on an adjustment screw 64 threadably mounted on a support bar 65 secured to the framework 12. It will be appreciated that the spring 56 serves to urge the rollers 38 into resilient engagement with the rollers 36. Also, it will be appreciated that a change in the upward force exerted on the shaft 40 by the surface 58 of the arm 52, and hence a change in the force with which the polyurethane rollers 38 are urged against the cooperating rollers 36, can be brought about by adjusting the adjustment screw 64.

As will be discussed in more detail later, there is a tendency for a note 46' (FIGS. 5 and 6) of poor quality to buckle in the region between the polyurethane rollers 36, 38 and the feed rollers 28, 32. Any deflection of the note 46' in this region above the feed path 48 by at least a predetermined amount (which in the present embodiment is typically 4.5 millimeters) is sensed by a first optical sensor 66 associated with a cooperating light source 67, and any deflection of the note 46' in this region below the feed path 48 by at least the same predetermined amount is sensed by a second optical sensor 68 associated with a cooperating light source 69. Sensing of the leading edge of a note after it has moved past the shafts 20 and 24 is carried out by two further optical sensors 70 and 72 respectively associated with cooperating light sources 73 and 74. The sensor 72 is spaced from the sensor 70 in the direction of the arrow A. The outputs of all the sensors 66, 68, 70 and 72 are applied to electronic control means 76 (FIG. 7).

Figure 3:
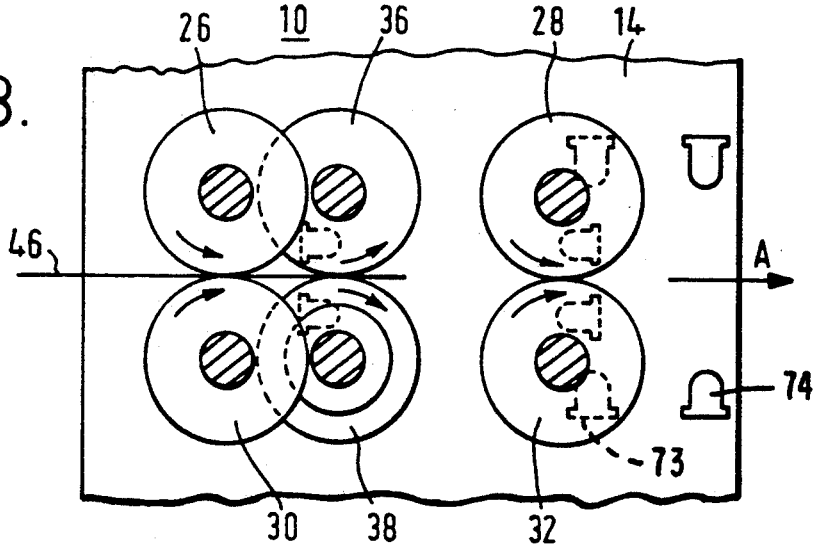
FIG. 3 is a schematic, elevational view of part of the mechanism of FIGS. 1 and 2, showing a currency note entered part way into the mechanism.

The operation of the apparatus in accordance with the present invention incorporating the limp note detect mechanism 10 and the electronic control means 76 will now be described with additional reference to FIGS. 3 and 7. Prior to a currency note such as the note 46 reaching the mechanism 10, the electronic control means 76 energizes the motor 44 so as to cause the rollers 26, 28, 30, 32, 36 and 38 to commence rotation. The leading long edge (right hand edge with reference to FIGS. 3 and 4) of the note 46 is fed by the previously mentioned external transport means (not shown) into the nip of the feed rollers 26, 30, whereupon the note 46 is drawn by the feed rollers 26, 30 into the mechanism 10 in the direction of the arrow A in FIG. 3 until the note 46 is also engaged by the polyurethane rollers 36, 38 as shown in FIG. 3. The rollers 36, 38 rotate at a greater peripheral speed than the rollers 26, 30, but as the note 46 is more firmly gripped by the rollers 26, 30 than by the rollers 36, 38, the note 46 is slidably engaged by the rollers 36, 38, with the peripheries of the rollers 36, 38 slipping in frictional manner over the note 46.

Figure 4:
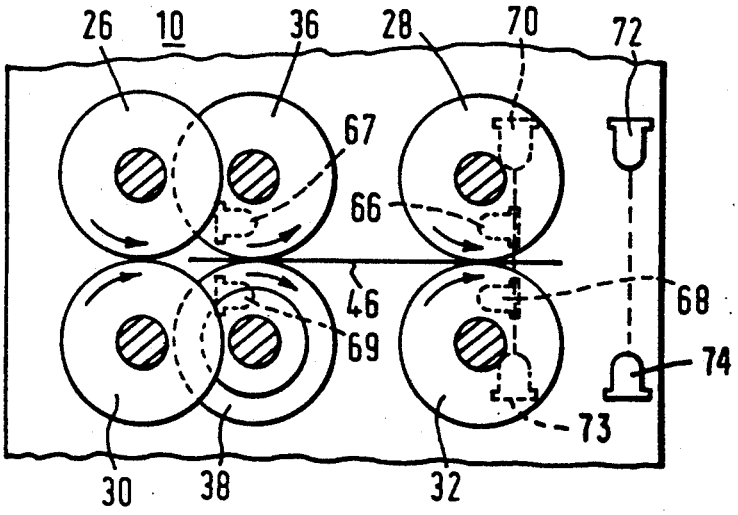
FIG. 4 is a view similar to FIG. 3, but showing a good quality currency note in a stiffness testing position in the mechanism.

The note 46 continues to be fed by the rollers 26, 30 and the rollers 36, 38 until the leading edge of the note 46 enters the nip of the rollers 28, 32 so as to be gripped by these rollers. Shortly after the note 46 becomes gripped by the rollers 28, 32, the trailing edge of the note 46 leaves the rollers 26, 30 so that the note 46 is now gripped only by the polyurethane rollers 36, 38 and the feed rollers 28, 32, as shown in FIG. 4. When the leading edge of the note 56 is sensed by the sensor 70, the electronic control means 76 commences to monitor the outputs of the sensors 66 and 68 to ascertain if there is any interruption in the light paths between the light sources 67 and 69 and the respective sensors 66 and 68. Monitoring of the outputs of the sensors 66 and 68 by the electronic control means 76 continues until the leading edge of the note 46 is sensed by the sensor 72, whereupon such monitoring ceases.

During the monitoring of the outputs of sensors 66, 68, the rollers 28, 32 firmly grip the note 46 and the rollers 36, 38 frictionally engage the note so that both the rollers 28, 32 and the rollers 36, 38 urge the note 46 along the feed path 48 (FIG. 2) in the direction of the arrow A. In this connection, it should be noted that the rollers 36, 38 exert on the note 46 a lower feeding force along the feed path 48 than the feeding force along the feed path 48 exerted on the note 46 by the rollers 28, 32. As previously mentioned, the peripheral speeds of the rollers 36, 38 are greater than those of the rollers 28, 32. Because of this difference in peripheral speeds, there is a tendency for the rollers 36, 38 to cause the note 46 to buckle, i.e. to bow away from the feed path 46 in one direction or the other, in the region between the rollers 36, 38 and the rollers 28, 32. The ability of the note 46 to resist such buckling depends on its quality, and in particular on its stiffness. In the situation illustrated in FIG. 4, the note 46 is sufficiently stiff to resist any significant buckling, and so there is no interruption in the light paths between the light sources 67, 69 and the sensors 66, 68. It should be understood that, while the note 46 is engaged by both the rollers 36, 38 and the rollers 28, 32, since the note 46 is more firmly gripped by the rollers 28, 32 than by the rollers 36, 38, the peripheries of the rollers 36, 38 slip over the note 46.

In the situation just described in relation to FIG. 4, the electronic control means 76 makes a determination that note 46 is of acceptable stiffness, by virtue of the fact that there occurred no buckling of the note 46 sufficient to bring about an interruption in the light paths between the light sources 67, 69 and the cooperating sensors 66, 68. Accordingly, the electronic control means 76 permits the note 46, after its trailing edge has left the rollers 28, 32, to be fed by further transport means (not shown) to a note loading station such as a station 78 (FIG. 8) for loading notes into a currency cassette for use in an ATM.

Figure 5:
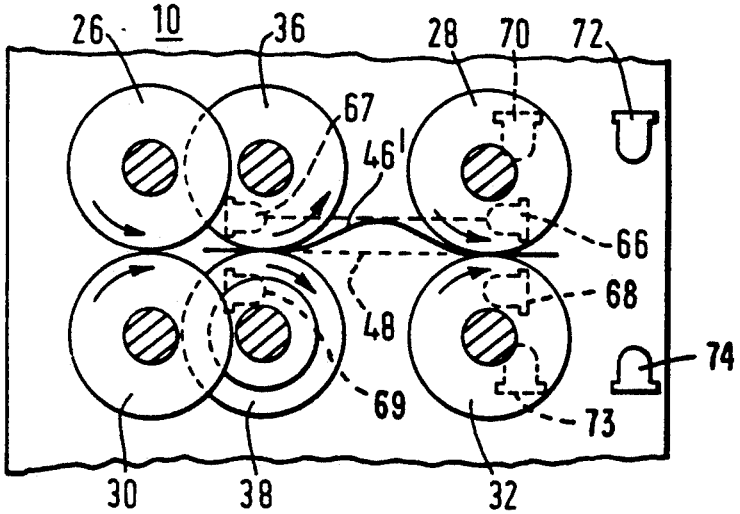
FIG. 5 is a view similar to FIG. 4, but showing a limp currency note in the stiffness testing position, the note being bowed in a first sense relative to the normal feed path for the note.
Figure 6:
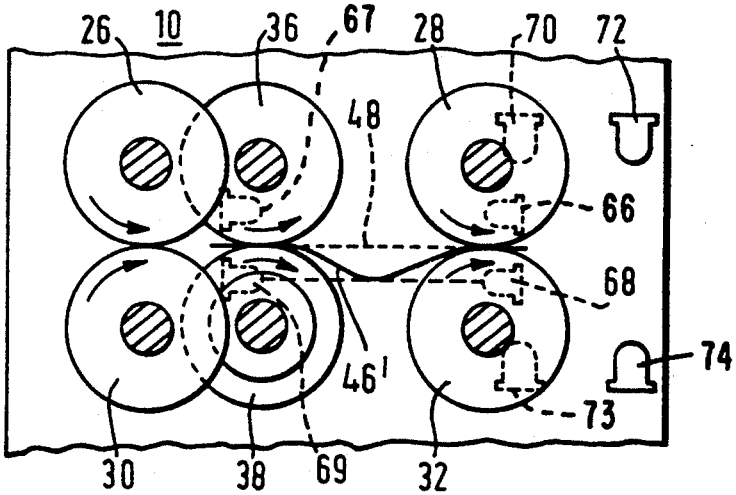
FIG. 6 is a view similar to FIG. 5, but showing a limp currency note bowed in the opposite sense relative to the normal feed path.

Referring now to FIGS. 5 and 6, if a poor quality note 46' which is limp in texture is fed to the limp note detect mechanism 10, then when the note 46' is engaged only by the rollers 36, 38 and the rollers 28, 32, that is to say after the training edge of the note 46' has left the rollers 26, 30, the frictional force exerted by the rollers 36, 38 on the note 46' is sufficient to cause the note 46' to buckle in the region between the rollers 36,38 and the rollers 28, 32. For example, the rollers 36, 38 may cause the note 46' to bow upwardly away from the feed path 48 as shown in FIG. 5 so as to interrupt the light path between the light source 67 and the sensor 66. Upon such interruption taking place, the sensor 66 applies a signal REJECT to the electronic control means 76 which signifies to the electronic control means 76 that the note 46' being tested has failed to fulfill the standard of stiffness required for it to be fed to the loading station (e.g. station 78). In response to receiving the signal REJECT, the electronic control means 76 in turn generates on an output line 79 (FIG. 7) a signal indicative that the tested note does not meet the required standard of stiffness. This last-mentioned signal is applied to a gate means 80 (FIGS. 7 and 8) and serves to actuate the gate means 80 so as to divert the note 46' to a rejected note container such as the container 82 schematically shown in FIG. 8.

Alternatively, during the period while the poor quality note 46' is engaged only by the rollers 36, 38 and the rollers 28, 32, the rollers 36, 38 may cause the note 46' to bow downwardly away from the feed path 48 as shown in FIG. 6, so as to interrupt the light path between the light source 69 and the sensor 68. In this case, the sensor 68 sends a signal REJECT to the electronic control means 76 which again causes the electronic control means 76 to actuate the gate means 80 so as to divert the note 46' to the previously mentioned rejected note container (e.g. container 82).

It should be understood that a signal REJECT is applied by the sensor 66 or the sensor 68 to the electronic control means 76 during the monitoring period corresponding to the period between the sensing of the leading edge of the note 46' by the sensor 70 and the sensing of this edge by the sensor 72.

In the embodiment described above, during the monitoring period, the sensors 66 and 68 sense a displacement of a currency note from the feed path 48 of about 4.5 millimeters. Thus, any buckling of a note during this period which gives rise to a displacement from the feed path 48 of at least this amount causes a signal REJECT to be sent to the electronic control means 76 and therefore causes the note to be rejected. By means of the adjustment screw 64, the limp note detect mechanism 10 can be adjusted to accept lower quality notes (as represented by the stiffness of the notes) or can be adjusted so that only higher quality notes are accepted. Thus, if the screw 64 is loosened so as to decrease the pressure exerted by the polyurethane rollers 36, 38 on a note being tested, then there is less frictional force exerted by the rollers 36, 38 on the note and hence there is less tendency for the rollers 36, 38 to bring about buckling of the note. In other words, loosening the adjustment screw 64 lowers the quality requirement of a note for it to be accepted by the mechanism 10. On the other hand, if the screw 64 is tightened, then the pressure exerted by the rollers 36, 38 on the note is increased so that there is a greater tendency for the rollers 36, 38 to bring about buckling of the note. Hence, tightening the screw 64 increases the quality requirement of a note for it to be accepted by the mechanism 10.

The use of the sensor 70 is important in that it ensures that the electronic control means 76 only monitors the outputs of the sensors 66 and 68 after a note is engaged by the rollers 28, 32. This arrangement avoids the possibility of the electronic control means 76 responding to a false REJECT signal generated as a result of the leading edge of a note diverging from the feed path 48 while moving between the rollers 36, 38 and the rollers 28, 32.

In the preferred embodiment described above, the spacing apart of the feed rollers 26, 30 and 28, 32 along the feed path 48 is such that, for the narrowest note tested by the mechanism 10, the leading edge of the note is gripped by the feed rollers 28, 32 before the trailing edge leaves the rollers 26, 30.

In a modification of the limp note detect mechanism 10 described above, the shaft 34 is driven by a motor separate from the motor 44 which drives the feed rollers 26, 28, 30 and 32. This modification enables the ratio of the peripheral speeds of the polyurethane rollers 36, 38 and the feed rollers 26, 28, 30 and 32 to be varied to obtain optimum operation of the mechanism 10 if notes of different thicknesses or surface textures are to be tested.

The limp note detect mechanism 10 has the advantage that it is of simple construction. In this connection it should be noted that the rollers 36, 38 and 28, 32 which serve to test the degree of stiffness of a note also serve to feed the note through the mechanism 10.

Referring now to FIG. 8, there is shown in block form a currency cassette loading system incorporating the limp note detect mechanism 10 in accordance with the present invention. The limp note detect mechanism 10 is located downstream of an input feed mechanism 84 which serves to feed currency notes one by one to the mechanism 10 from a stack of notes held in the mechanism 84. Currency notes which are determined by the mechanism 10 and the electronic control means 76 associated therewith as having a stiffness not meeting a required standard are diverted by the gate 80 to the rejected note container 82. Currency notes meeting the required stiffness standard are transported via the gate 80 to a detector 85 which detects the presence of staples or other attachments to the currency notes. After passing through the detector 85, the currency notes are fed in turn through a detector 86 which detects crinkles, through a detector 88 which detects holes, folds and tears, and through a detector 90 which detects the denomination value of the notes. If any of the currency notes is found to be unacceptable by any of the detectors 84, 86 and 88 or is found to be of the wrong denomination by the detector 90 then it is transported along a branch line to a further rejected note container 92. Otherwise the note is fed to the loading station 78 where it is loaded into a currency cassette.

While the forms of the invention shown and described herein are admirably adapted to fulfill the object primarily stated, it is to be understood that it is not intended to confine the invention to the forms or embodiments disclosed herein, for it is susceptible of embodiment in various other forms within the scope of the appended claims.

What is claimed is:

1. Apparatus for testing the stiffness of a sheet, comprising:

transport means for feeding said sheet along a feed path, said transport means including first and second rotary means arranged to engage with said sheet so as to urge said sheet along said feed path, said second rotary means being spaced from said first rotary means downstream thereof, said transport means also including drive means for driving said first and second rotary means simultaneously when said sheet is being fed from said first rotary means to said second rotary means, whereby the peripheral speed of said first rotary means is greater than that of said second rotary means, said first rotary means being arranged to engage frictionally with said sheet and to exert on said sheet a lower feeding force along said feed path than the feeding force along said feed path exerted on said sheet by said second rotary means; and sheet deflection sensing means for sensing a deflection of a portion of said sheet between said first and second rotary means away from said feed path by at least a predetermined amount to measure the stiffness of said sheet.

2. The apparatus of claim 1, in which said first rotary means includes first and second roller means which are arranged to engage opposite faces of said sheet.

3. The apparatus of claim 2, in which said transport means also includes spring means for urging said second roller means into resilient engagement with said first roller means.

4. The apparatus of claim 2, in which said first roller means are driven by said drive means and said second roller means are rotatably mounted on a shaft.

5. The apparatus of claim 2, in which said transport means also includes adjustment means for adjusting the pressure exerted in operation by said first and second roller means on said sheet.

6. The apparatus of claim 1, also including first and second sensors disposed on opposite sides of said feed path, said first sensor being arranged to sense a deflection of said portion of said sheet away from said feed path in a first direction by at least said predetermined amount, and said second sensor being arranged to sense a deflection of said portion of said sheet away from said feed path in a second direction, opposite to said first direction, by at least said predetermined amount.

7. The apparatus of claim 1, also including gating means operated by the sheet deflection sensing means for diverting rejected sheets not having a required degree of stiffness; and a rejected sheet container into which said rejected sheets are diverted.

8. The apparatus of claim 7, also including detector means for detecting sheet defects and located to receive non-rejected sheets passing through said gating means for testing said sheets for defects.

9. The apparatus of claim 8, also including loading means located to receive non-rejected sheets passing through said detector means for loading said non-rejected sheets into a container.

10. The apparatus of claim 9, in which said sheets are currency notes and said loading means comprises means for loading said currency notes into a currency note cassette.

11. The apparatus of claim 8, also including a second rejected sheet container into which sheets rejected by said detector means are diverted.

12. The apparatus of claim 8, in which said detector means comprises means for detecting crinkles in said sheets.

13. The apparatus of claim 8, in which said detector means comprises means for detecting the presence of staples and other attachments to the sheets.

14. The apparatus of claim 8, in which said detector means comprises means for detecting holes, folds and tears in said sheets.

15. The apparatus of claim 8, in which said sheets are currency notes and said detector means comprises means for detecting the denomination of said currency notes.

16. Apparatus for testing the stiffness of a sheet, comprising:

transport means for feeding said sheet along a feed path, said transport means including first and second rotary means arranged to engage with said sheet so as to urge said sheet along said feed path, the sheet engaging material of said first rotary means being more compressible than the sheet engaging material of said second rotary means, said second rotary means being spaced from said first rotary means downstream thereof, said transport means also including drive means for driving said first and second rotary means, whereby the peripheral speed of said first rotary means is greater than that of said second rotary means, said first rotary means being arranged to engage frictionally with said sheet and to exert on said sheet a lower feeding force along said feed path than the feeding force along said feed path exerted on said sheet by said second rotary means; and sheet deflection sensing means for sensing a deflection of a portion of said sheet between said at first and second rotary means away from said feed path by at least a predetermined amount.

17. Apparatus for testing the stiffness of a sheet, comprising:

transport means for feeding said sheet along a feed path, said transport means including first and second rotary means arranged to engage with said sheet so as to urge said sheet along said feed path, said second rotary means being spaced from said first rotary means downstream thereof, said transport means also including drive means for driving said first and second rotary means, whereby the peripheral speed of said first rotary means is greater than that of said second rotary means, said first rotary means being arranged to engage frictionally with said sheet and to exert on said sheet a lower feeding force along said feed path than the feeding force along said feed path exerted on said sheet by said second rotary means;

sheet deflection sensing means for sensing a deflection of a portion of said sheet between said first and second rotary means away from said feed path by at least a predetermined amount; and electronic control means connected to said sheet deflection sensing means and arranged to generate a signal indicative that said sheet does not meet a certain standard of stiffness in response to said sheet deflection sensing means generating a signal indicative of a deflection of said portion of said portion of said sheet away from said feed path by at least said predetermined amount.

18. The apparatus of claim 17, also including further sensing means for sensing the leading edge of said sheet subsequent to said sheet being engaged by said second rotary means, said electronic control means being arranged to monitor the output of said sheet deflection sensing means in response to the sensing of said leading edge by said further sensing means.

19. Apparatus for testing the stiffness of a sheet, comprising:

transport means for feeding said sheet along a feed path, said transport means including first and second rotary means arranged to engage with said sheet so as to urge said sheet along said feed path, said second rotary means being spaced from said first rotary means downstream thereof, said transport means also including drive means for driving said first and second rotary means, whereby the peripheral speed of said first rotary means is greater than that of said second rotary means, said first rotary means being arranged to engage frictionally with said sheet and to exert on said sheet a lower feeding force along said feed path than the feeding force along said feed path exerted on said sheet by said second rotary means; and sheet deflection sensing means for sensing a deflection of a portion of said sheet between said first and second rotary means away from said feed path by at least a predetermined amount;

said transport means including third rotary means arranged to rotate with the same peripheral speed as said second rotary means and spaced from said first rotary means upstream thereof, said second and third rotary means being arranged to engage said sheet simultaneously during part of the movement of said sheet along said feed path.

* * * * *